United States Patent [19]

Cash

[11] Patent Number: 4,683,595

[45] Date of Patent: Aug. 4, 1987

[54] CONVERTIBLE MATERNITY NON-MATERNITY APPAREL

[76] Inventor: Damon L. Cash, 5467-C Randolph Cir., Washington, D.C. 20336

[21] Appl. No.: 904,297

[22] Filed: Sep. 8, 1986

[51] Int. Cl.[4] ..... A41D 1/22

[52] U.S. Cl. ..... 2/105; 2/76; 2/221; 2/269

[58] Field of Search ..... 2/105, 90, 221, 114, 2/74, 75, 76, 74, 269

[56] References Cited

U.S. PATENT DOCUMENTS

D. 127,643 12/1940 Knebel .
2,591,513 4/1952 Cormier ..... 2/74
2,747,197 5/1956 Bailey ..... 2/221
3,089,149 5/1963 Kelleam ..... 2/76
3,473,167 10/1969 Jeffrey .
4,434,046 8/1982 Zebell .
4,494,248 1/1985 Holder ..... 2/269

*Primary Examiner*—Doris L. Troutman
*Attorney, Agent, or Firm*—Joseph J. Zito

[57] ABSTRACT

An article of wearing apparel designed and suited for women in their child bearing years. The apparel is uniquely designed to provide a proper and fashionable fit prior to pregnancy, during the term of pregnancy and after delivery through utilization of interchangeable elements. A coordinating panel constructed with mating and aligned fastening elements is added to the main body of the garment to increase the girth by proportionate increments in the desired areas to create the proper fit for a pregnant woman's increased volume.

6 Claims, 6 Drawing Figures

CONVERTIBLE MATERNITY NON-MATERNITY APPAREL

BACKGROUND OF THE INVENTION

The present invention relates to women's garments. More particularly, the present invention relates to convertible maternity wear.

During the term of a pregnancy, the woman carrying the child will increase in size; and very early in the pregnancy will no longer fit into the clothes she wore prior to conception. Maternity clothes have therefore been developed which are more generously cut and tailored to provide a looser, more comfortable fit to the pregnant woman.

An alternative present in the prior art has been to incorporate stretch material into the waist and hip areas of pants or dresses. These panels are found to be unattractive and provide an unsatisfactory fit except during a limited portion of the pregnancy term, and do not fit at all when the woman is no longer pregnant. Often an oversized, extra long blouse is worn untucked to cover the stretch material.

Pregnant women often remain in the work place for the majority of the term of their pregnancy. This creates a need for more exceptable, fashionable and therefore expensive clothing suited to the special needs of pregnant women. Enlarged business suits and dresses are available for the working pregnant woman, however, these can represent a significant investment and may only be worn for a limited time.

Stretch material can be inappropriate for formal business apparel as is the wearing of an oversized, untucked blouse. In some instances, such as taught in U.S. Pat. No. 4,343,046 to Zebell, the manufacturer of an article will attempt to cover over an expandable panel with a panel of non-stretch material. The effects of a stretch panel on the shape, fit and overall appearance of a dress can only be partially masked in this manner. Any significant increase in size, such as that associated with pregnancy, will cause distortion in the essential pattern of a dress such as that illustrated in Zebell.

The prior art fails to provide a dress which can be worn by a woman before and after pregnancy as well as during the term of pregnancy, which is appropriate and attractive at all times, and is comfortable to the wearer.

SUMMARY OF THE INVENTION

It is an object of the present invention to provide an easily convertible garment to be worn by a woman before, during and after pregnancy, which will provide a comfortable fit and appropriate attire for the working woman both pregnant and non-pregnant.

It is a further object of the present invention to provide the pregnant working woman with appropriate business attire while saving her the investment in a new wardrobe to be worn only during the term of pregnancy.

It is another object of the present invention to provide pregnant women with a fashionable alternative to stretch fabric and large baggy blouses.

The present invention accomplishes these desired objectives by the incorporation of a properly shaped, coordinated panel with correctly positioned buttons, button holes and snaps with a dress having a front opening designed to accommodate the panel.

BRIEF DESCRIPTION OF THE DRAWINGS

For a further understanding of the nature and objects of the present invention, reference should be had to the following detailed description, taken in conjunction with the accompanying drawings in which like parts are given like reference numerals and wherein.

DETAILED DESCRIPTION OF THE PREFERRED EXEMPLARY EMBODIMENTS

Figure 1:
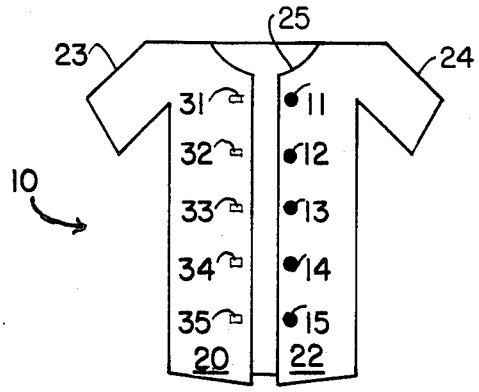
FIG. 1 is a front view of a dress constructed in the manner taught by the present invention and configured for wearing before or after pregnancy.

The body 10 of the dress illustrated in FIG. 1 is of a design with an overlapping front lapel 20 secured by buttons 11–15 attached to the opposing lapel 22. Buttons 11–15 are mated with corresponding holes 31–35 in overlapping lapel 20. The body 10 also has sleeves 23 and 24 of desirable length, an appropriate neckline 25 and hemline 26. The back 26 of the body 10 can be of solid, textured or pleated design dependent upon the desired fashion of the dress.

Figure 2:
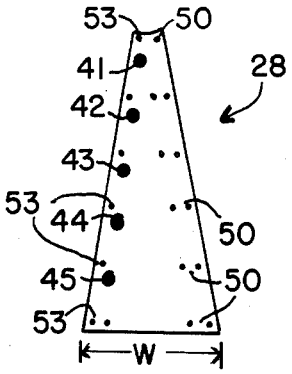
FIG. 2 is a front view of a panel to be inserted into the front of the dress illustrated in FIG. 1 for use during the pregnancy term.
Figure 3:
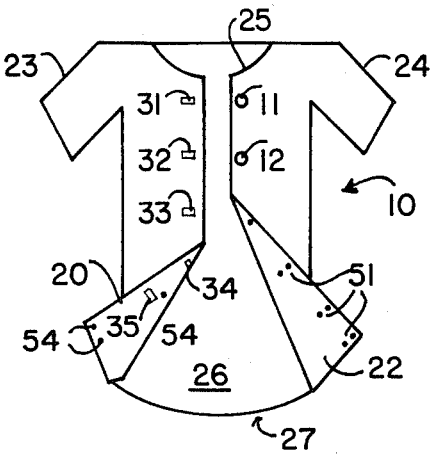
FIG. 3 is a front view of the dress of FIG. 1 with the lower portion of the lapels folded back.

The inside of the lapel 22, as illustrated in FIG. 3, is fitted with a double row of snaps 51 in corresponding arrangement to snaps 50 incorporated into the removable panel 28 illustrated in FIG. 2. The inside of lapel 20 is fitted with a row of snaps 54 in corresponding arrangement to snaps 53 incorporated into the opposite edge of panel 28.

The dress comprised of the body 10 as illustrated in FIG. 1 is suitable for wearing by a woman who is not pregnant. The dress is designed in any of numerous styles which have a front opening, the style illustrated is only for the sake of example and has been greatly simplified for ease of illustration and explanation. The dress may incorporate a belt at the waistline or may be pleated as alternative examples of style.

The material may be from any desired fabric without regard to stretch characteristics and may be imprinted with any pattern. The body 10 of the dress would in most outward appearances resemble a dress of ordinary fashion and is therefore suitable to wear in environments where casual baggy clothing would not be appropriate.

When the wearer of this dress becomes pregnant and develops and extended waist size, the dress is easily convertible to a configuration which maintains a proper fit and neat appearance. The body 10 of the dress is opened in the front and the panel 28 is inserted between the two lapels 20 and 22 thus increasing the girth of the dress.

The panel 28 is held in place by mating of snaps 50 along one edge of panel 28 with snaps 51 along the inside of lapel 22. The wearer then puts on the dress and secures the front by engagement of buttons 41–45 in button holes 31–35. Snaps 53 along the second edge of panel 28 are engaged with snaps 54 on the inside of lapel 20 to maintain a smooth fit between lapel 20 and panel 28 to give a neater appearance to the dress. Button 11–15 remain exposed but are no longer functioning to secure the garment.

Figure 4:
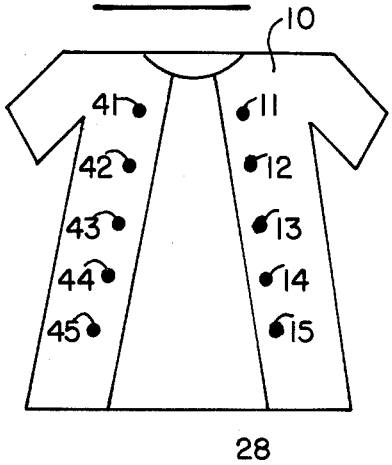
FIG. 4 is a front view of the dress of FIG. 1 configured for wearing during the pregnancy term by attachment of the panel of FIG. 2.

The dress, as illustrated in FIG. 4, includes the body 10 with the edges of panel 28 secured behind the lapels 20 and 22. In this configuration the dress is appropriate for utilization by a pregnant woman. The dress has not utilized any stretch portions and so therefore there is no resultant distortion of the dress, and no stretch material to hide. The panel 28 will have a width dimension "w" of appropriate size to accommodate the increased size of a woman during pregnancy. Panels of different widths can be utilized during different stages of pregnancy to provide a wider variety of sizes for the same dress body 10 to accommodate differing stages of growth during pregnancy.

A woman will not regain her pre-pregnancy figure immediately after delivery and cannot properly wear a maternity dress, therefore an intermediate size dress will be needed. The body 10 combined with a panel 28 of a lesser width dimension "w" will satisfy the interim needs of the post-partum woman.

The panel 28 is for example made of the same color and material as the body 10 of the dress, or is constructed of a contrasting or coordinating color or pattern for example to alter the appearance of the dress for different occasions. Preferably several panels of differing sizes, colors or patterns can be combined with a single or multiple dress bodies to form a widely varied wardrobe for use by a woman whose size is changing.

Other fastening methods can be utilized without departing from the scope and spirit of the inventive concept herein taught, for example, the snaps 50–54 can be replaced by velcro or hooks and eyes or any other convenient easily fastened device which can be placed behind a lapel without causing a bulge or wrinkle in the outward appearance of the dress. The buttons could be replaced by other overlapping securing means such as string ties or loops.

Figure 5A:
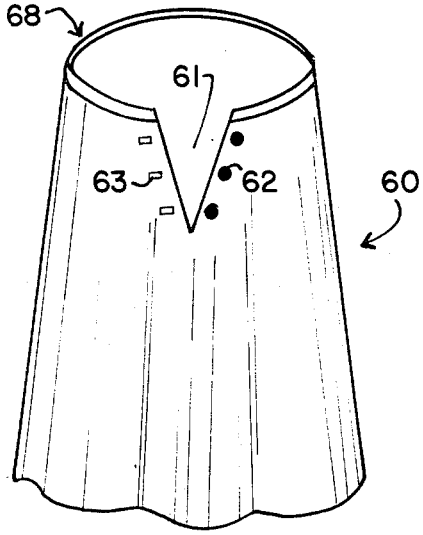
FIGS. 5 A and B are front views of a skirt and its insertable panel.
Figure 5B:
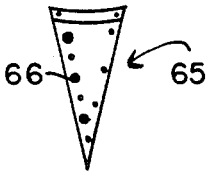

A skirt 60 made in accordance with the teachings of the present invention is illustrated in FIG. 5A. The skirt 60 has a front opening 61 with button 62 and button hole 63 closures. An insertable panel 65 is illustrated in FIG. 5B having buttons 66 in corresponding arrangement to button holes 63 and having snaps 67 arranged to mate with snaps on the inside of skirt 60 in much the same manner as the snaps 51 and 54 on the inside of lapels 20 and 22 of FIG. 3.

With panel 65 incorporated into skirt 60 the waist 68 will be increased and the hemline 69 will remain unaltered to give a proper fit for pregnant woman.

Other articles of clothing can also be constructed for the pregnant woman under the teachings of the present invention. For example, a blouse with a removable panel could be made for pregnant women from the teachings of the present invention. Pants could be constructed with an insertable panel, similar to the construction of the skirt illustrated in FIGS. 5 A and B, to be placed between the two sides of a front fly closure replacing the buttons shown in the illustrative example herein with dual zippers or pant-style snaps for example.

Clothing can also be made from the teachings of this invention for other persons who tend to gain weight periodically and need larger clothing for a temporary period of time. This would include men or women old or young with clothing tailored to the general requirements of the individuals who will wear them.

Because many varying and different embodiments may be made within the scope of the inventive concept herein taught, and because many modifications may be made in the embodiment(s) herein detailed in accordance with the descriptive requirements of the law, it is to be understood that the details herein are to be interpreted as illustrative and not in a limiting sense.

What is claimed is:

1. A convertible article of wearing apparel to be worn by a woman before, during and after pregnancy, comprising:

a body portion having a back, sleeves, a neckline, a hemline and a front, a panel portion of essentially planar triangular configuration for attachment to said front of said body, wherein said front has first and second lapels defining an opening extending from said neckline to said hemline, and closure means for securing said opening in a closed configuration, wherein said body alone comprises a first article of wearing apparel and wherein said panel has anchoring means for cooperating with said closure means and with said lapels to secure said panel into said front opening between said first and second lapels when said opening is in an open configuration, wherein said panel and said body comprise a second article of wearing apparel when secured by said anchoring means and said closure means.

2. The apparel of claim 1, wherein, said panel has a front face and a rear face, and a portion of the peripheral areas of the front face are in abutting relation to the rear face of the lapels, and said anchoring means are attached to the front face of said panel in the area of said lapel abutment.

3. The article of wearing apparel of claim 2, wherein said closure means comprise buttons and corresponding button holes, and wherein said anchoring means comprise snap halves attached to the inner face of said lapels and corresponding snap halves attached to the abutting face of said panel.

4. A convertible article of wearing apparel, comprising a body portion having a waist, a hemline and an opening extending from said waist to a point between said waist and said hemline, a panel portion of essentially planar triangular configuration for attachment to said body across said opening, closure means for securing said opening in a closed configuration, and wherein said panel has anchoring means for cooperating with said closure means and said body to secure said panel in said opening when said opening is in a closed configuration.

5. The apparel of claim 4, wherein, said panel has a front face and a rear face, and a portion of the peripheral areas of the front face are in abutting relation to the rear face of the edges of said opening, and said anchoring means are attached to the front face of said panel in the area of said edge abutment.

6. The article of wearing apparel of claim 5, wherein said closure means comprise buttons and corresponding button holes, and wherein said anchoring means comprise snap halves attached to the inner face of said opening edges and corresponding snap halves attached to the abutting face of said panel.

* * * * *